United States Patent [19]

Simmons

[11] 4,436,220

[45] Mar. 13, 1984

[54] HERMETIC PACKAGE USING MEMBRANE SEAL

[75] Inventor: Louis D. Simmons, Arnold, Md.

[73] Assignee: The United States of America as represented by the Secretary of the Air Force, Washington, D.C.

[21] Appl. No.: 393,266

[22] Filed: Jun. 29, 1982

[51] Int. Cl.[3] ..... B65D 41/00

[52] U.S. Cl. ..... 220/359; 220/256; 53/477; 53/478

[58] Field of Search ..... 220/256, 258, 359; 53/477, 478

[56] References Cited

U.S. PATENT DOCUMENTS

| | | | |
|---|---|---|---|
| 198,306 | 12/1877 | Leland . | |
| 1,883,076 | 10/1932 | Stough . | |
| 1,958,142 | 5/1934 | Holthe | 220/75 |
| 1,982,883 | 12/1934 | Richardson | 220/27 |
| 2,880,859 | 4/1959 | Tupper | 206/46 |
| 3,204,810 | 9/1965 | Eckman | 220/29 |
| 3,823,468 | 7/1974 | Hascoe | 29/588 |
| 3,874,549 | 4/1975 | Hascoe | 220/200 |
| 4,190,176 | 2/1980 | Hascoe | 220/359 |
| 4,261,504 | 4/1981 | Cowan | 229/43 |
| 4,328,905 | 5/1982 | Hardt | 220/359 |
| 4,359,169 | 11/1982 | Helms et al. | 220/359 |

*Primary Examiner*—George T. Hall

*Attorney, Agent, or Firm*—Donald J. Singer; Bobby D. Scearce

[57] ABSTRACT

An improved solderable hermetically sealed container and method for sealing same is provided which comprises in a preferred embodiment, a hollow container having a solderable peripheral surface defining the opening to the container, a thin, solderable metallic membrane covering the opening and solderable surface of the container, a solder seal interfacing the membrane and the solderable surface of the container, and a protective lid covering the membrane and being removably attached to the container body. If desired, an adhesive seal between the membrane and protective lid may be provided to protect the membrane from excessive vibration.

4 Claims, 3 Drawing Figures

HERMETIC PACKAGE USING MEMBRANE SEAL

RIGHTS OF THE GOVERNMENT

The invention described herein may be manufactured and used by or for the Government of the United States for all governmental purposes without the payment of any royalty.

BACKGROUND OF THE INVENTION

This invention relates generally to the field of hermetically sealed packages or containers, and more particularly to an improved solderable hermetically sealed container and method of sealing.

A conventional hermetically sealed package for the shipment of components may consist of a machined metallic box and cover of suitable material to satisfy environmental requirements. The lid is solder sealed to the box to form the hermetic seal, and in the assembly thereof, high temperatures for the duration of the soldering process often result in unacceptably high heat input to the package with attendant detrimental effects either upon the components being packaged or upon the desired atmosphere to be maintained within the package during shipment. Further, a desirable seal is often not achieved.

The present invention provides an improved hermetically sealed and solderable container, and method for sealing, including a thin, solderable and resealable membrane seal between the body portion of the container and a protective cover. The use of the membrane seal allows quick and reliable solderable seals with minimum heat input to the package. The protective cover provides support for the membrane seal and may be mechanically secured to the body portion of the container. If the package is to be subjected to vibration during shipment, an adhesive applied between the membrane seal and the cover ensures the integrity of the membrane. The configuration of the present invention provides a container which ensures survivability of the packaged components, and may be applicable to packages of any size. Further, the package of this invention may be reusable by applying heat to the solder seal to remove the membrane for resealing.

It is therefore, an object of the present invention to provide an improved hermetically sealed and solderable container.

It is a further object of the invention to provide a solderable hermetically sealed container which may be assembled using minimal heat input.

Yet another object of this invention is to provide a resealable hermetically sealed container.

A further object is to provide a simple and reliable method of hermetically sealing a solderable container.

These and other objects of the present invention will become apparent as the detailed description of representative embodiments thereof proceeds.

SUMMARY OF THE INVENTION

In accordance with the foregoing principles and objects of the present invention, an improved solderable hermetically sealed container and method for sealing same is provided which comprises in a preferred embodiment, a hollow container having a solderable peripheral surface defining the opening to the container, a thin, solderable metallic membrane covering the opening and solderable surface of the container, a solder seal interfacing the membrane and the solderable surface of the container, and a protective lid covering the membrane and being removably attached to the container body. If desired, an adhesive seal between the membrane and protective lid may be provided to protect the membrane from excessive vibration.

DESCRIPTION OF THE DRAWINGS

The present invention will be more clearly understood from the following detailed description of specific embodiments thereof read in conjunction with the accompanying drawings wherein.

DETAILED DESCRIPTION

Figure 1:
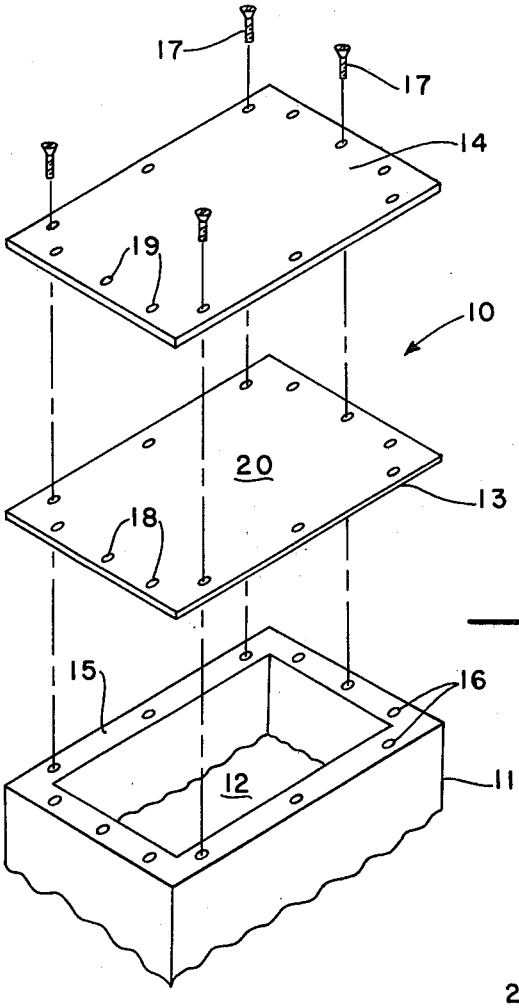
FIG. 1 is an exploded isometric view of one embodiment of the present invention.

Referring now to the accompanying drawings, FIG. 1 is an exploded view of one embodiment of the present invention. The hermetic package as shown in FIG. 1 and designated by the reference numeral 10, comprises generally a hollow container body 11 defining a void volume 12 for receiving articles or materials to be sealed. A thin membrane seal 13 and protective cover or lid 14 provide the desired hermetic seal and protective cover as hereinafter described.

The container body 11 of the embodiment shown in FIG. 1 may be of rectangular cross section having a closed bottom (not shown) and four upstanding walls defining a surface 15 which interfaces with membrane seal 13. A hermetic seal is provided by soldering the peripheral edges of membrane seal 13 to surface 15 of container body 11, and therefore, surface 15 may comprise any suitable solderable material, such as a tin-plated surface, brass, Kovar and aluminum, or the like. Membrane seal 13 may comprise any thin, solderable metallic sheet, such as the tin-plated brass sheet of about 0.010 inch (0.0254 cm) thickness used in the fabrication of a representative assembly of FIG. 1.

Cover 14 comprises a plate of any suitable material which when assembled to body 11 provides a protective covering for membrane 13. A metallic plate 0.090 inch thick was used in a demonstration of the FIG. 1 embodiment.

Surface 15 may have therein a plurality of drilled and tapped holes 16 for receiving a plurality of screws 17 in the assembly of container 10. Consequently, member 13 has a plurality of holes 18 and cover 14 has a plurality of holes 19, appropriately sized, spaced around the periphery thereof and registering with holes 16 for the assembly of container 10.

In the assembly of container 10, to surface 15 is applied a suitable amount of solder and membrane 13 is applied thereover. The periphery of membrane 13 is then heated to flow the solder interfacing surface 15 and membrane seal 13. Because membrane seal 13 is thin, a hermetic solder seal is effected without substantial heat input, thereby providing maximum protection to the article(s) packaged within container body 11. In the described embodiment of FIG. 1, however, the 0.010 inch tin-plated brass membrane seal 13 has sufficient strength to allow removal, by localized peripheral heating thereof, and resealing for subsequent use. The structure of container body 11 and cover 14 are also intended for multiple use.

In the event that container 10 may be subject to excessive vibration during use as would threaten the integrity of the membrane seal 13, a coating of adhesive of such as an epoxy, resin, silicon rubber, or the like may be applied to the upper surface 20 of membrane seal 13 following soldering thereof to surface 15 of container body 11. Adhesive selection will depend upon the use of the package. Cover 14 will then adhere to membrane 13 over a substantial portion of the interface therebetween and prevent structural damage to the membrane 13 due to the vibration to which container 10 is subjected.

Figure 2:
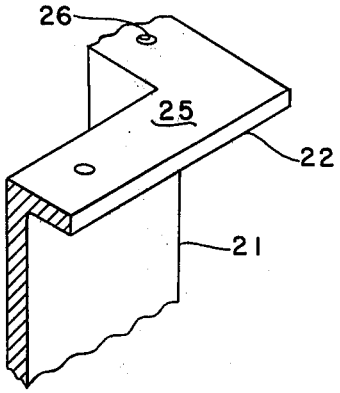
FIG. 2 is a partial view of the body portion of the container of the present invention illustrating a peripheral flanged configuration.
Figure 3:
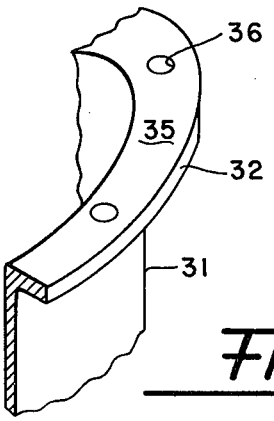
FIG. 3 illustrates an alternate peripheral flanged configuration.

The peripheral shape of container 11 and the solderable surface 15 it presents may be alternatively configured as shown in FIGS. 2 and 3. As shown in FIG. 2, a rectangular container body 21 may include an outwardly extending peripheral flange 22 supporting a solderable surface 25. Further, as exemplified in FIG. 3, container body 31 may have a circular or oval cross section and include a flange 32 supporting a solderable surface 35. The embodiments of FIGS. 2 and 3 may include, respectively, holes 26 and 36 for receiving assembly screws in a manner similar to that described for the FIG. 1 embodiment.

The present invention, as hereinabove described, therefore provides an improved hermetically sealed container, and method of providing the hermetic seal. It is understood that certain modifications to the invention as described may be made as might occur to one with skill in the applicable field. Therefore, all embodiments contemplated hereunder have not been shown in complete detail. Other embodiments may be developed without departing from the spirit of the invention or from the scope of the appended claims.

I claim:

1. A solderable, hermetically sealed reuseable container which comprises:

a. a container body defining a cavity therein and presenting a solderable surface defining an opening for said container:

b. a thin, reuseable, solderable metallic membrane for hermetically sealing said opening by interfacing with said solderable surface by the application of heat around the periphery of said membrane;

c. a solder seal interfacing said membrane and said solderable surface;

d. a protective plate covering said membrane; and e. means for removably attaching said protective plate to said container body.

2. The container as recited in claim 1 further comprising a layer of adhesive between said protective plate and said membrane for vibration dampening said plate and membrane.

3. In a method of hermetically sealing a container having a hollow body portion and presenting a solderable surface defining an opening thereinto, an improvement comprising:

a. overlaying a thin, reuseable, solderable metallic membrane onto said solderable surface;

b. soldering said membrane to said solderable surface by the application of heat to said membrane around the periphery thereof; and c. attaching a protective cover to said container over said membrane.

4. The method as recited in claim 3 further comprising providing a vibration dampening adhesive layer between said membrane and said protective cover.

* * * * *